US007373976B2

(12) United States Patent
Casey

(10) Patent No.: US 7,373,976 B2
(45) Date of Patent: May 20, 2008

(54) WELL PRODUCTION OPTIMIZING SYSTEM

(76) Inventor: Danny M. Casey, 211 Stubblefield Lake Rd., Huntsville, TX (US) 77340

( * ) Notice: Subject to any disclaimer, the term of this patent is extended or adjusted under 35 U.S.C. 154(b) by 339 days.

(21) Appl. No.: 10/992,060

(22) Filed: Nov. 18, 2004

(65) Prior Publication Data

US 2006/0102346 A1 May 18, 2006

(51) Int. Cl.
*E21B 47/04* (2006.01)
*E21B 43/12* (2006.01)

(52) U.S. Cl. ..... 166/250.15; 166/250.03; 166/250.04; 166/53; 181/121

(58) Field of Classification Search ..... 166/250.03, 166/250.04, 53, 250.15; 181/102, 104, 113, 181/121
See application file for complete search history.

(56) References Cited

U.S. PATENT DOCUMENTS 4,352,376 A 10/1982 Norwood
4,408,676 A 10/1983 McCoy
4,750,583 A 6/1988 Wolf
4,793,178 A 12/1988 Ahern et al.
4,921,048 A 5/1990 Crow et al.
5,132,904 A 7/1992 Lamp
5,146,991 A 9/1992 Rogers, Jr.
5,834,710 A 11/1998 Finnestad
6,209,637 B1 4/2001 Wells
6,241,014 B1 6/2001 Majek et al.
6,595,287 B2 7/2003 Fisher
6,634,426 B2 10/2003 McCoy et al.
6,725,916 B2 * 4/2004 Gray et al. ..... 166/68.5
2004/0163806 A1 8/2004 Hadley

OTHER PUBLICATIONS

International Search Report, dated Feb. 23, 2007 (PCT/US05/40573).

* cited by examiner

*Primary Examiner*—Jennifer H Gay
*Assistant Examiner*—Shane Bomar
(74) *Attorney, Agent, or Firm*—Winstead PC; Henry Ehrlich

(57) ABSTRACT

A method and system for controlling a producing cycle in a well, during the production cycle, for optimizing production from the well including disrupting fluid in a wellbore with a pulse generator to create a pressure pulse transmitted through the fluid in the wellbore, detecting the pressure pulse created and the pressure pulse reflected from objects located within the wellbore, wherein the objects may include a liquid/gas interface and a producing apparatus such as a plunger, converting the detection of the pressure pulse and the reflected pressure pulses to a signal, computing the signals to determine the well status and controlling production of the fluid from the wellbore based on the well status.

48 Claims, 4 Drawing Sheets

WELL PRODUCTION OPTIMIZING SYSTEM

FIELD OF THE INVENTION

The present invention relates to well production and more specifically to optimizing artificial lift production systems.

BACKGROUND

In the life of most wells the reservoir pressure decreases over time resulting in the failure of the well to produce fluids utilizing the formation pressure solely. As the formation pressure decreases, the well tends to fill up with liquids, such as oil and water, which inhibits the flow of gas into the wellbore and may prevent the production of liquids. It is common to remove this accumulation of liquid by artificial lift systems such as plunger lift, gas lift, pump lifting and surfactant lift wherein the liquid column is blown out of the well utilizing the reaction between surfactants and the liquid.

Common to these artificial lift systems is the necessity to control the production rate of the well to achieve economical production and increase profitability. It is common for the production cycle of a particular lift system to be estimated based on known well characteristics and then adjusted over time through trial and error. Prior art systems have been utilized to automate the control system such that incremental changes are automatically implemented in the production cycle until the lift system fails, and then the production cycle is readjusted to a point before failure. A need still exists for a method and system for optimizing an artificial lift system in real-time.

SUMMARY OF THE INVENTION

In view of the foregoing and other considerations, the present invention relates to well production and more specifically to optimizing artificial lift production systems.

Accordingly, a system for controlling a production cycle in a well, during the production cycle, for optimizing production from the well is provided. The system includes a flow-control valve in fluid connection with a wellbore, the flow-control valve being moveable between a closed position to prevent fluid flow from the wellbore and an open position allowing fluid flow from the wellbore. A pulse generator in fluid communication with the wellbore adapted for transmitting a pressure pulse into the fluid in the wellbore. The pulse generator creating a disruption by physically entering the fluid or briefly interrupting the fluid flow in a flowing well. A receiver is in operational connection with the wellbore for receiving the pressure pulse and the pressure pulse reflections from a surface in the wellbore and for sending an electrical signal in response to the received pressure pulses. And a controller in functional connection with the flow-control valve, the pulse generator and the receiver; wherein the controller operates the position of the flow-control valve in response to the well status determined by the controller from the receipt and analysis of the electrical signals from the receiver.

A system for determining the position of a plunger in a tubing string is provided. The system includes a plunger ascending in a tubing string in response to fluid pressure in the wellbore. A pulse generator in fluid communication with a fluid flowing in the tubing string adapted for interrupting the flowing fluid to cause a pressure pulse to be transmitted down the tubing string. A receiver in communication with the tubing string adapted to receive the pressure pulse and a reflected pressure pulse from the plunger. The system also includes a controller adapted for receiving the signals from the receiver identifying both the pressure pulse and the reflected pressure pulse, wherein the controller analyzes the signals to determine the position of the plunger in the tubing string.

A method for controlling a producing cycle in a well, during the production cycle, for optimizing production from the well is provided. The method includes the steps of disrupting fluid in a wellbore with a pulse generator to create a pressure pulse transmitted through the fluid in the wellbore, detecting the pressure pulse created and the pressure pulse reflected from objects located within the wellbore, wherein the objects may include a liquid/gas interface and a producing apparatus such as a plunger, converting the detection of the pressure pulse and the reflected pressure pulses to a signal, computing the signals to determine the well status and controlling production of the fluid from the wellbore based on the well status.

A method of controlling a production cycle of a plunger lift system is provided. The method comprising the steps of operating a flow-control valve to prevent flow of fluid from a tubing disposed in a wellbore, thus shutting in the well for an off-time. Operating a pulse generator in fluid connection with the tubing string to create a pressure pulse in the tubing stream. Sending a signal identifying receipt of the pressure pulse to an automated controller. Reflecting the pressure pulse from objects in the tubing and sending a signal identifying receipt of the reflected pressure pulse to the automated controller. Computing the signals by the automated controller to determine the off-time well status. Operating the flow-control valve to permit fluid flow from the tubing and a plunger to ascend in the tubing based on the off-time well status. Again, operating the pulse generator in fluid connection with the tubing string to create a pressure pulse in the tubing string. Sending a signal identifying receipt of the pressure pulse to an automated controller. Reflecting the pressure pulse from the plunger in the tubing and sending a signal identifying receipt of the reflected pressure pulse to the automated controller. Computing the signals by the automated controller to determine the plunger well status and operating the flow-control valve in response to the plunger well status. Then operating the pulse generator to create another pressure pulse in the tubing string and sending a signal identifying receipt of the pressure pulse to an automated controller. Reflecting the pressure pulse from objects in the tubing and sending a signal identifying receipt of the reflected pressure pulse to the automated controller. Computing the signals by the automated controller to determine the after-flow well status and operating the flow-control valve to prevent fluid flow from the tubing based on the after-flow well status.

In an embodiment of the invention, the pulse generator may include a valve body forming a fluid channel in communication with the fluid in the wellbore; a cross-bore having a first end and a second end, the cross-bore intersecting the channel, and a piston having a piston head that is moveably disposed in the cross-bore in a manner such that the piston head may be selectively moved to a position in the channel.

In another embodiment of the invention, the the pulse generator may include a fast-acting valve adapted for releasing a burst of fluid from the wellbore. A chamber may be connected to the fast-acting valve for capturing the burst of fluid from the wellbore.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
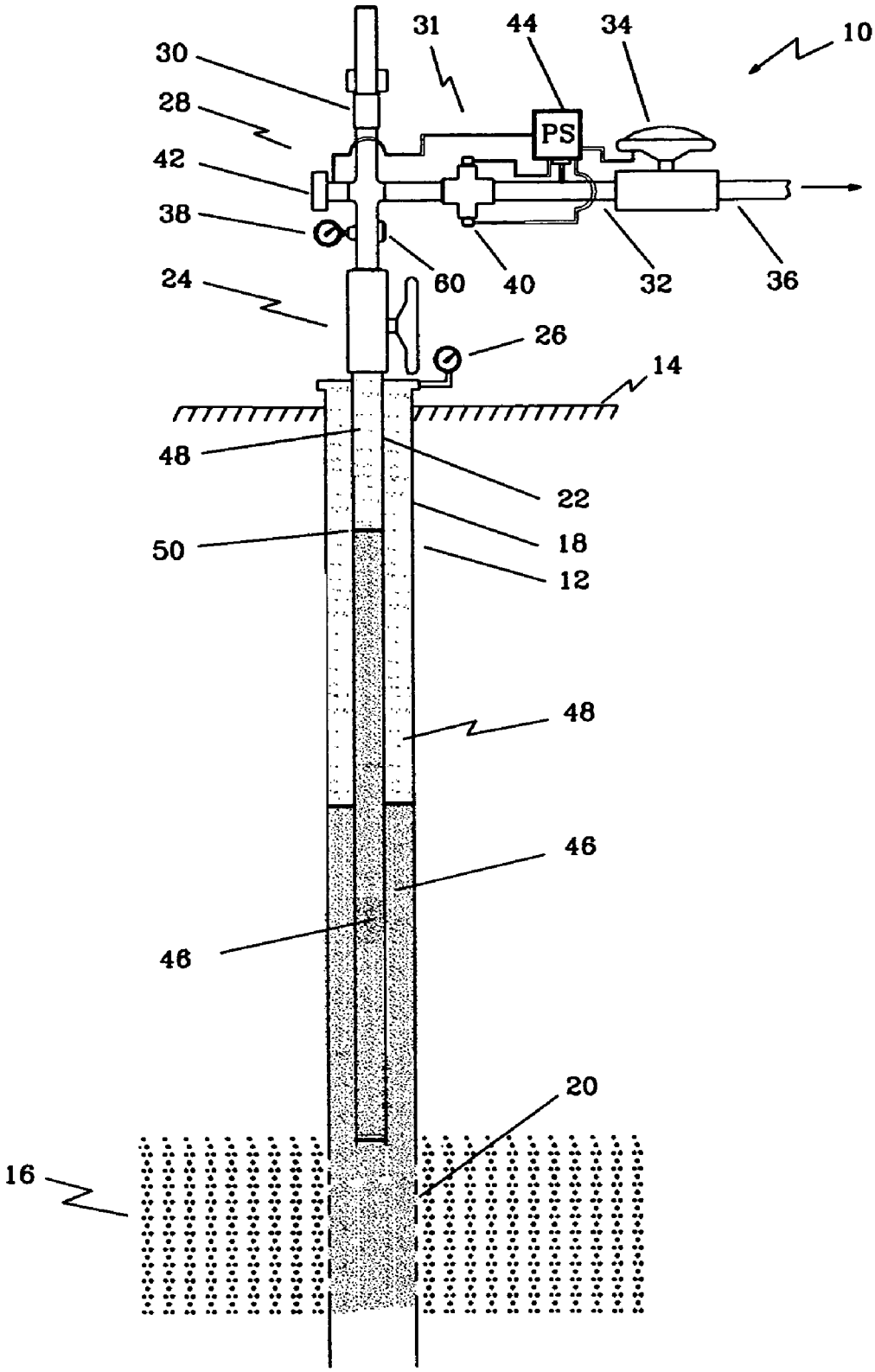
FIG. 1 is a schematic drawing of a well production optimizing system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic drawing of a well production optimizing system of the present invention, generally denoted by the numeral 10. The figure is illustrative of well under artificial lift production, which may include systems such as, but not limited to, gas lift, surfactant lift, beam pumping, and plunger lift. The well includes a wellbore 12 extending from the surface 14 of the earth to a producing formation 16. Wellbore 12 may be lined with a casing 18 including perforations 20 proximate producing formation 16. The surface end of casing 18 is closed at surface 14 by a wellhead generally denoted by the numeral 24. A casing pressure transducer 26 is mounted at wellhead 24 for monitoring the pressure within casing 18.

A tubing string 22 extends down casing 18. Tubing 22 is supported by wellhead 24 and in fluid connection with a production "T" 28. Production "T" 28 includes a lubricator 30 and a flow line 31 having a section 32, also referred to as the production line, upstream of a flow-control valve 34, and a section 36 downtream of flow-control valve 34. Downstream section 36, also referred to generally as the salesline, may lead to a separator, tank or directly to a salesline. Production "T" 28 typically further includes a tubing pressure transducer 38 for monitoring the pressure in tubing 22.

Wellbore 12 is filled with fluid from formation 16. The fluid includes liquid 46 and gas 48. The liquid surface at the liquid gas interface is identified as 50. With intermittent lift systems it is necessary to monitor and control the volume of liquid 46 accumulating in the well to maximize production.

Well production optimizing system 10 includes flow-control valve 34, a flow-interruption pulse generator 40, a receiver 42 and a controller 44. Flow-control valve 34 is positioned within flow line 31 and may be closed to shut-in wellbore 12, or opened to permit flow into salesline 36.

Flow-interruption pulse generator 40 is connected in flow line 31 so as to be in fluid connection with fluid in tubing 22. Although pulse generator 40 is shown connected within flow line 31 it should be understood that pulse generator 40 may be positioned in various locations such that it is in fluid connection with tubing 22 and the fluid in wellbore 12.

Pulse generator 40 is adapted to interrupt or affect the fluid within the tubing 22 in a manner to cause a pressure pulse to be transmitted down tubing 22 and to be reflected back upon contact with a surface. Pulse generator 40 is described in more detail below.

Receiver 42 is positioned in functional connection with tubing 22 so as to receive the pressure pulses created by pulse generator 40 and the reflected pressure pulses. Receiver 42 recognizes pressure pulses received and converts them to electrical signals that are transmitted to controller 44. The signal is digitized, and the digitized data is stored in controller 44.

Controller 44 is in operational connection with pulse generator 40, receiver 42 and flow-valve 34. Controller 44 may also be in operational connection with casing pressure transducer 26, tubing pressure transducer 38 and other valves (not shown). Controller 44 includes a central processing unit (CPU), such as a conventional microprocessor, and a number of other units interconnected via a system bus. The controller includes a random access memory (RAM) and a read only memory (ROM), and may include flash memory. Controller 44 may also include an I/O adapter for connecting peripheral devices such as disk units and tape drives to the bus, a user interface adapter for connecting a keyboard, a mouse and/or other user interface devices such as a touch screen device to the bus, a communication adapter for connecting the data processing system to a data processing network, and a display adapter for connecting the bus to a display device which may include sound. The CPU may include other circuitry not shown herein, which will include circuitry found within a microprocessor, e.g., an execution unit, a bus interface unit, an arithmetic logic unit (ALU), etc. The CPU may also reside on a single integrated circuit (IC).

Controller 44 may be located at the well or at a remote locations such as a field or central office. Controller 44 is functionally connected to flow-control valve 34, receiver 42, and pulse generator 40 via hard lines and/or telemetry. Data from receiver 42 may be received, stored and evaluated by controller 44 utilizing software stored on controller 44 or accessible via a network. Controller 44 sends signals for operation of pulse generator 40 and receives information regarding receipt of the pulse from pulse generator 40 via receiver 42 for storage and use. The data received by controller 44 is utilized by controller 44 to manipulate the production cycle, during the production cycle in real-time, to optimize production. Controller 44 may also be utilized to display real-time as well as historical production cycles in various formats as desired.

An example of the operation of optimizing system 10 is described with reference to FIG. 1 to determine the liquid level in tubing 22. Controller 44 sends a signal to pulse generator 40 to create a pressure pulse within tubing 22. Pulse generator 40 and its operation is disclosed in detail below. The pressure pulse travels down tubing 22 and is reflected back up tubing 22 upon encountering objects or surfaces such as liquid surface 50, plungers, collars, subsurface formation and the like. Receiving unit 42, which is in fluid or sonic connection with pulse generator 40 and tubing 22 receives the pulse from pressure generator 40 and the reflected pressure pulses. The pulse received is converted to an electrical signal and transmitted to controller 44 for storage and use. This data received by controller 44 may be filtered and analyzed by the controller to determine well status information such as, but not limited to, the position of liquid surface 50, liquid volume in the well, and the change in liquid level 50 over time. Controller 44 may then utilize this information to operate flow-control valve 34 between the open and closed position as necessary.

Figure 2:
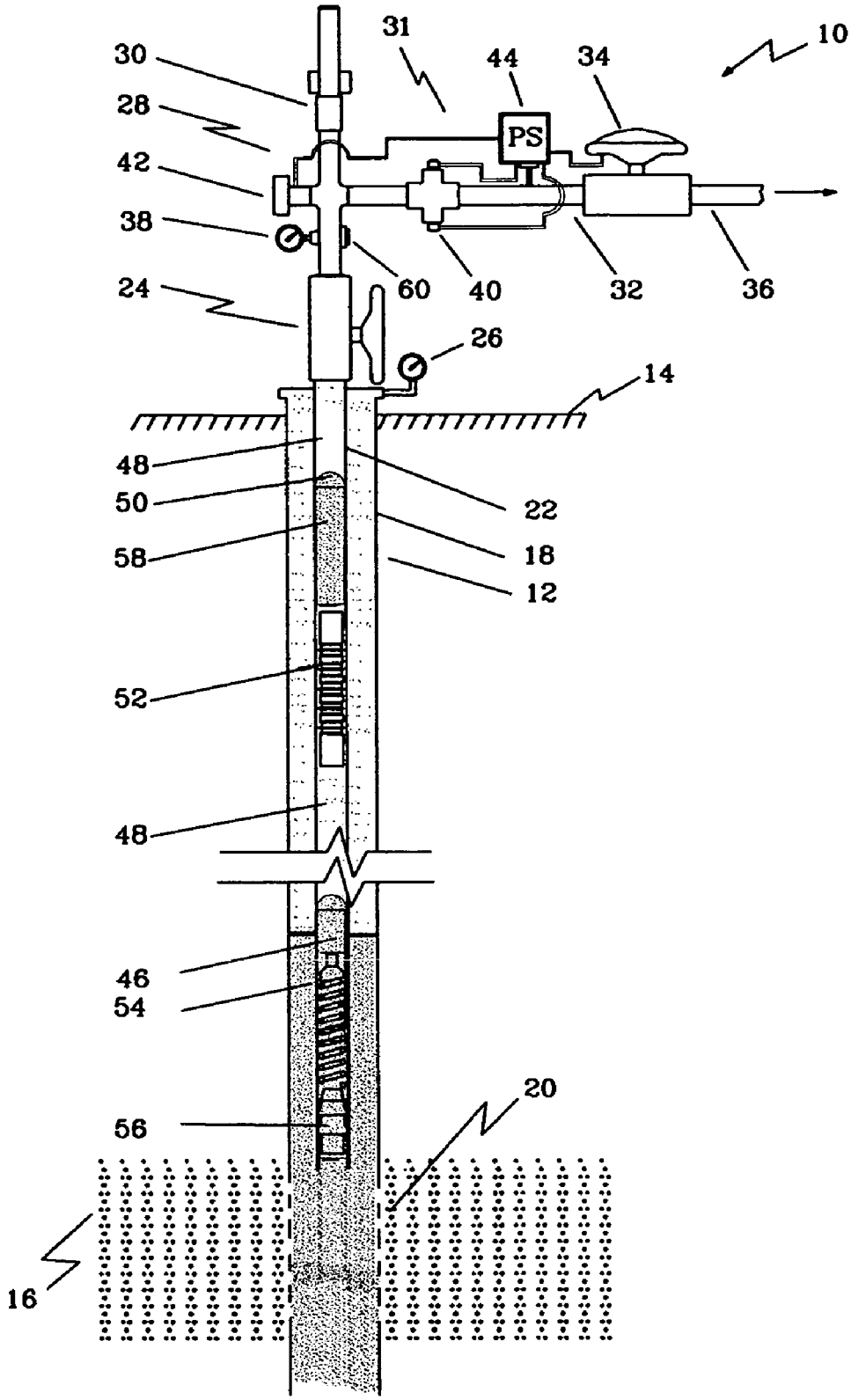
FIG. 2 is a schematic drawing of a well production optimizing system utilizing plunger lift.

FIG. 2 is a schematic drawing of a well production optimizing system 10 utilizing a plunger-lift system. The well includes a wellbore 12 extending from the surface 14 of the earth to a producing formation 16. Wellbore 12 may be lined with a casing 18 including perforations 20 proximate producing formation 16. The surface end of casing 18 is closed at surface 14 by a wellhead generally denoted by the numeral 24. A casing pressure transducer 26 is mounted at wellhead 24 for monitoring the pressure within casing 18.

A tubing string 22 extends down casing 18. Tubing 22 is supported by wellhead 24 and in fluid connection with a production "T" 28. Production "T" 28 includes a lubricator 30 and a flow line 31 having a section 32, also referred to as the production line, upstream of a flow-control valve 34, and a section 36 downstream of flow-control valve 34. Downstream section 36, also referred to as the salesline, may lead to a separator, tank or directly to a salesline. Production "T" 28 typically further includes a tubing pressure transducer 38 for monitoring the pressure in tubing 22.

A plunger 52 is located within tubing 22. A spring 54 is positioned at the lower end of tubing 22 to stop the downward travel of plunger 52. Fluid enters casing 18 through perforations 20 and into tubing 22 through standing valve 56. Lubricator 30 holds plunger 52 when it is driven upward by gas pressure. A liquid slug 58 is supported by plunger 52 and lifted to surface 14 by plunger 52.

Well production optimizing system 10 includes flow-control valve 34, a flow-interruption pulse generator 40, a receiver 42 and a controller 44. Flow-control valve 34 is positioned within flow line 31 and may be closed to shut-in wellbore 12, or opened to permit flow into salesline 36.

Plunger-lift systems are a low-cost, efficient method of increasing and optimizing production in wells that have marginal flow characteristics. The plunger provides a mechanical interface between the produced liquids and gas. The free-traveling plunger is lifted from the bottom of the well to the surface when the lifting gas energy below the plunger is greater than the liquid load and gas pressure above the plunger.

In a typical plunger-lift system operation, the well is shut-in by closing flow-control valve 34 for a pre-selected time period during which sufficient formation pressure is developed within casing 18 to move plunger 52, along with fluid collected in the well, to surface 34 when flow-control valve 34 is opened. This shut-in period is often referred to as "off time."

After passage of the selected "off-time" the production cycle is started by opening flow-control valve 34. As plunger 52 rises in response to the downhole casing pressure, fluid slug 58 is lifted and produced into salesline 36. In the prior art plunger-lift systems when plunger 52 reaches the lubricator its arrival is noted by arrival sensor 60 and a signal is sent to controller 44 to close flow-control valve 34 and end the cycle. It also may be desired to allow control-valve 34 to remain open for a pre-selected time to flow gas 48. The continued flow period after arrival of plunger 52 at lubricator 30 is referred to as "after-flow." Upon completion of a pre-selected after-flow period controller 44 sends a signal to flow-control valve 34 to close. Thereafter, plunger 52 falls through tubing 22 to spring 54. The production cycle then begins again with an off-time, ascent stage, after-flow, and descent stage.

Optimizing system 10 of the present invention permits the production cycle of the plunger-lift system to be monitored and controlled in real-time, during each production cycle, to optimize production from the well. Controller 44 may be initially set for pre-selected off-time and after-flow. To control and optimize the well production, controller 44 intermittently operates pulse generator 40 creating a pressure pulse that travels down tubing 22 and is reflected off of liquid surface 50 and plunger 52. The pressure pulse and reflections are received by receiver 42 and sent to controller 44 and stored as data. Controller 44 may receive further data such as casing pressure 26, tubing pressure 38 and flow rates into salesline 36. Additional, data such as well fluid compositions and characteristics may be maintained by controller 44. This cumulative data is monitored and analyzed by controller 44 to determine the status of the well. This status data may include data, such as, but not limited to liquid surface 50 level, fluid volume in the well, the rate of change of the level of liquid surface 50, the position of plunger 52 in tubing 22, the speed of travel of plunger 52, and the in-flow performance rate (IPR). The status data may then be utilized by controller 44 to alter the operation of the production system. This status data may also be utilized by controller 44 or an operator to determine the wear and age characteristics of plunger 22 for replacement or repair.

For example, during the off-time the well status data may indicate that the downhole pressure is sufficient to lift the accumulated liquid 46 to surface 14 before the pre-selected off-time has elapsed. Or that the liquid volume is accumulating to a degree to inhibit the operation of plunger 52. Controller 44 may then open flow-control valve 34 to initiate production.

In another example, as plunger 52 ascends in tubing 22, the well status data calculated and received by controller 44 may indicate that the rate of ascension is too fast and may result in damage to plunger 52 and/or lubricator 30. Controller 44 may then signal flow-control valve 34 to close or restrict flow through valve 34 thereby slowing or stopping the ascension of plunger 52.

In a further example, controller 44 may recognize that plunger 52 is ascending too slow, stalled or falling during the ascension stage. Controller 44 may then close flow-control valve 34 to terminate the trip, or further open flow-control valve 34 or open a tank valve to allow plunger 52 to rise to lubricator 30.

In a still further example, during after-flow the controller 44 well status data may indicate that liquid 46 is accumulating in tubing 22, therefore controller 44 can signal flow-control valve 44 to close and allow plunger 52 to descend to spring 54. Then a new production cycle may be initiated.

As can be determined by the examples of operation of optimizing system 10, an artificial lift system can be controlled in real-time in a manner not heretofore recognized. Although operation of optimizing system 10 of the present invention is disclosed with reference to a plunger-lift system in FIG. 2, optimizing system 10 is adapted for operation in any type of artificial or intermittent lift system including gas lift and surfactant lift.

Figure 3:
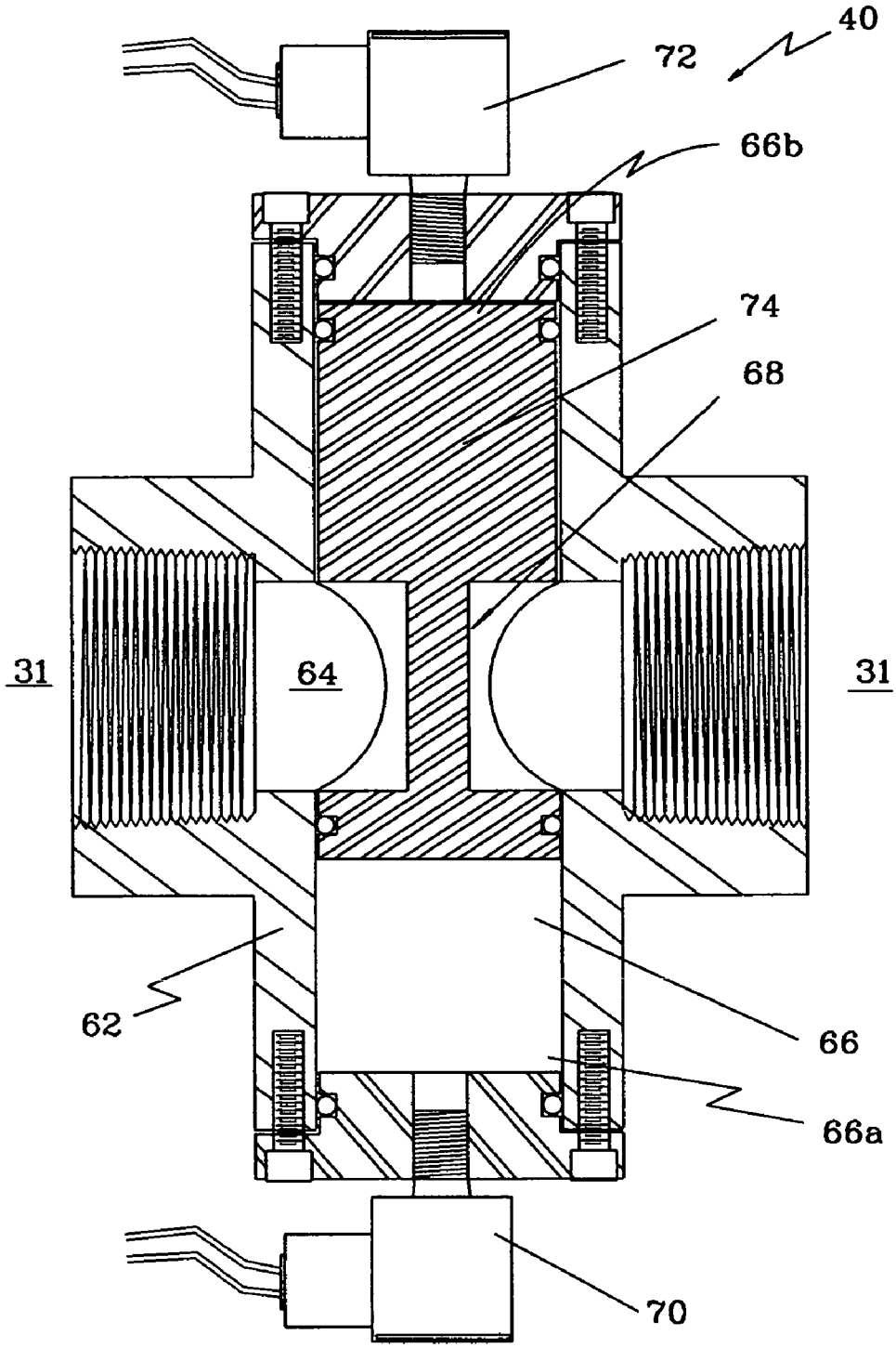
FIG. 3 is a partial cross-sectional view of a flow-interruption pulse generator of the present invention.

FIG. 3 is a partial cross-sectional view of a flow-interruption pulse generator 40 of the present invention. Pulse generator 40 includes a valve body 62 forming a fluid channel 64, a cross-bore 66 intersecting channel 64 and a piston 68. Electromagnetic solenoids 70 and 72 are connected to the first and second ends 66*a* and 66*b* of bore 66 respectively. Solenoids 70 and 72 are functionally connected to controller 44 (FIGS. 1 and 2) for selectively venting bore 66 and motivating movement of piston 68. Operation of solenoids 70 and 72 moves piston head 74 from the second end 66*b* of bore 66 into channel 64 and then back into bore 66.

Operation of pulse generator 40 to create a pressure pulse is described with reference to FIGS. 1 through 3. Pulse generator 40 is connected within flowline 31 through channel 64. Controller sends a signal to solenoid 70 to vent motivating piston 68 and moving piston head 74 into channel 64. Controller 44 then sends a signal to solenoid 72 to vent motivating piston 68 and moving piston head 74 from channel 64 and toward second bore end 66*b*. This fast acting movement of piston head 74 into flow channel 64 creates a pressure pulse that travels through the fluid in flowline 31 and tubing 22.

Figure 4:
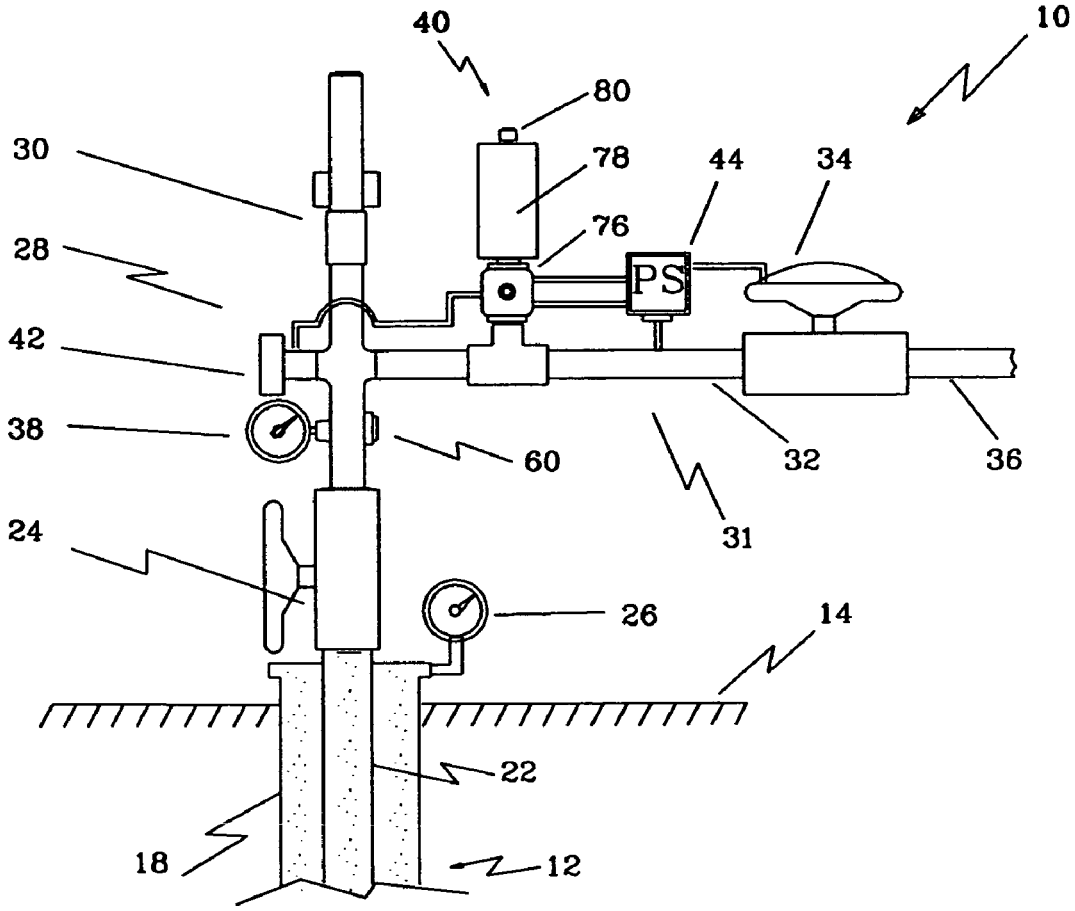
FIG. 4 is a view of another embodiment of a flow-interruption pulse generator of the present invention.

FIG. 4 is a view of another embodiment of a flow-interruption pulse generator 40 of the present invention. Pulse generator 40 includes a fast acting, motor driven valve 76 in fluid connection with flowline 31. Motor driven valve 76 is in operational connection with controller 44. To create a pressure pulse in flowline 31 and tubing 22, controller 44 substantially instantaneously opens and closes valve 76 releasing gas from flowline 31. Pulse generator 40 may include a vent chamber 78 connected to fast-acting valve 76. Vent chamber 78 may further include a bleed valve 80 to facilitate bleeding gas captured in vent chamber 78 to be discharged to the atmosphere.

From the foregoing detailed description of specific embodiments of the invention, it should be apparent that a method and apparatus for monitoring and optimizing an artificial lift system that is novel and unobvious has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A system for controlling a production cycle in a well, during the production cycle, for optimizing production from the well, the optimizing system comprising:

a flow-control valve in fluid connection with a wellbore, the flow-control valve moveable between a closed position to prevent fluid flow from the wellbore and an open position allowing fluid flow from the wellbore;

a pulse generator positioned in fluid communication with the wellbore such that the fluid flows from the wellbore through the pulse generator, the pulse generator selectively interrupting the fluid flowing from the wellbore causing a pressure pulse to be transmitted in the wellbore;

a receiver in operational connection with the wellbore for receiving the pressure pulse and pressure pulse reflections from a surface in the wellbore and for sending an electrical signal in response to the received pressure pulses; and a controller in functional connection with the flow-control valve, the pulse generator and the receiver; wherein the controller operates the position of the flow control valve in response to a well status determined by the controller from the receipt and analysis of the electrical signals from the receiver.

2. The system of claim 1, wherein the controller signals the pulse generator to create a pressure pulse.

3. The system of claim 1, wherein the surface that reflects the pressure pulse includes a liquid surface.

4. The system of claim 1, wherein the surface that reflects the pressure pulse includes a plunger.

5. The system of claim 1, wherein the well status includes the level of the liquid in the wellbore.

6. The system of claim 1, wherein the well status includes:

the level of the liquid in the wellbore; and the volume of the liquid in the wellbore.

7. The system of claim 1, wherein the well status includes the position of the plunger in the wellbore.

8. The system of claim 1, wherein the well status includes:

the position of the plunger in the wellbore; and the speed of travel of the plunger in the wellbore.

9. The system of claim 8, wherein the well status further includes:

the level of the liquid in the wellbore; and the volume of the liquid in the wellbore.

10. The system of claim 1, wherein the pulse generator corn rises:

a valve body forming a fluid channel through which the fluid from the wellbore flows;

a cross-bore having a first end and a second end, the cross-bore intersecting the channel; and a piston having a piston head, the piston moveably disposed in the cross-bore in a manner such that the piston head may be selectively moved to a position in the channel to interrupt the fluid flow from the wellbore.

11. The system of claim 1, wherein the pulse generator comprises:

a fast-acting valve adapted for releasing a burst of fluid from the wellbore.

12. The system of claim 11, further including a chamber in connection with the fast-acting valve for capturing the burst of fluid from the wellbore.

13. A system for determining the position of a plunger in a tubing string positioned in a wellbore, the system comprising:

a plunger ascending in the tubing string in response to fluid pressure in the wellbore;

a pulse generator positioned in fluid communication with a fluid flowing in the tubing string such that the fluid flows from the wellbore through the pulse generator, the pulse generator selectively interrupting the flowing fluid to cause a pressure pulse to be transmitted down the tubing string;

a receiver in communication with the tubing string adapted to receive the pressure pulse and a reflected pressure pulse from the plunger; and a controller adapted for receiving signals from the receiver identifying the pressure pulse and the reflected pressure pulse and adapted to analyze the signals to determine the position of the plunger in the tubing string.

14. The system of claim 13, wherein the pulse generator comprises:

a valve body forming a fluid channel through which the fluid from the wellbore flows;

a cross-bore having a first end and a second end, the cross-bore intersecting the channel; and a piston having a piston head, the piston moveably disposed in the cross-bore in a manner such that the piston head may be selectively moved to a position in he channel to interrupt the fluid flow from the well.

15. The system of claim 13, wherein the pulse generator comprises:

a fast-acting valve adapted for releasing a burst of fluid from the wellbore.

16. The system of claim 15, further including a chamber in connection with the fast-acting valve for capturing the burst of fluid from the wellbore.

17. A method for controlling a producing cycle in a well, during the production cycle, for optimizing production from the well, the method comprising the steps of:

interrupting fluid flow from a wellbore with a pulse generator to create a pressure pulse transmitted through the fluid in the wellbore;

detecting the pressure pulse created and the pressure pulse reflected from objects located within the wellbore;

converting the detection of the pressure pulse and the reflected pressure pulses to a signal;

computing the signals to determine well status; and automatically controlling production of the fluid from the wellbore based on the well status.

18. The method of claim 17, wherein the objects that reflect the pressure pulse includes a liquid surface.

19. The method of claim 17, wherein the objects that reflect the pressure pulse include a plunger.

20. The method of claim 19, wherein the objects that reflect the pressure pulse include a liquid surface.

21. The method of claim 17, wherein the well status include a level of the liquid in the wellbore.

22. The method of claim 17, wherein the well status include:

a level of a liquid in the wellbore; and a volume of the liquid in the wellbore.

23. The method of claim 17, wherein the well status include; the position of a plunger in the wellbore.

24. The method of claim 17, wherein the well status include:

a position of a plunger in the wellbore; and the speed of travel of the plunger in the wellbore.

25. The method of claim 24, wherein the well status further includes:

a level of a liquid in the wellbore; and the volume of the liquid in the wellbore.

26. The method of claim 17, wherein the pulse generator comprises:

a valve body forming a fluid channel through which the fluid from the wellbore flows;

a cross-bore having a first end and a second end, the cross-bore intersecting the channel; and a piston having a piston head, the piston moveably disposed in the cross-bore in a manner such that the piston head may be selectively moved to a position in the channel to interrupt the fluid flow from the wellbore.

27. The method of claim 17, wherein the pressure pulse is created by a pulse generator comprising:

a fast-acting valve adapted for releasing a burst of fluid from the wellbore.

28. The method of claim 27, wherein the pulse generator further includes a chamber in connection with the fast-acting valve for capturing the burst of fluid from the wellbore.

29. A method of controlling a production cycle of a plunger lift system in a wellbore, the method comprising the steps of:

a) operating a flow-control valve to prevent flow of fluid from a tubing disposed in a wellbore;

operating a pulse generator in fluid connection with the tubing string to create a pressure pulse in the tubing string;

sending a signal identifying receipt of the pressure pulse to automated controller;

reflecting the pressure pulse from objects in the tubing;

sending a signal identifying receipt of the reflected pressure pulse to the automated controller;

computing the signal; by the automated controller to determine the off-time well status;

b) operating the flow-control valve to prevent fluid flow from the tubing and a plunger to ascend in the tubing based on the off-time well status;

operating the pulse generator in fluid connection with the tubing string to create a pressure pulse in the tubing string;

sending a signal identifying receipt of the pressure pulse to the automated controller;

reflecting the pressure pulse from the plunger in the tubing;

sending a signal identifying receipt of the reflected pressure pulse to the automated controller;

computing the signals by the automated controller to determine the plunger well status;

operating the flow-control valve in response to the plunger well status;

c) operating the pulse generator in fluid connection with the tubing string to create a pressure pulse in the tubing string;

sending a signal identifying receipt of the pressure pulse to an automated controller;

reflecting the pressure pulse from objects in the tubing;

sending a signal identifying receipt of the reflected pressure pulse to the automated controller;

computing the signals by the automated controller to determine the after-flow well status; and d) operating the flow-control valve to prevent fluid flow from the tubing based on the after-flow well status.

30. The method of claim 29, wherein the objects that reflect the pressure pulse include a liquid surface.

31. The method of claim 29, wherein the off-time well status includes the level of the liquid in the wellbore.

32. The method of claim 29, wherein the off-time well status includes:

the level of the liquid in the wellbore; and the volume of the liquid in the wellbore.

33. The method of claim 29, wherein the plunger well status includes:

the position of the plunger in the wellbore; and the speed of travel of the plunger in the wellbore.

34. The method of claim 29, wherein the after-flow well status includes the level of the liquid in the wellbore.

35. The method of claim 29, wherein the after-flow well status includes:

the level of the liquid in the wellbore; and the volume of the liquid in the wellbore.

36. The method of claim 29, wherein:

the off-time well status includes the level of the liquid in the wellbore;

the after-flow well status includes the level of the liquid in the wellbore; and the plunger well status includes the position of the plunger in the wellbore and the speed of travel of the plunger in the wellbore.

37. The method of claim 29, wherein the pulse generator comprises:

a valve body forming a fluid channel in communication with the fluid in the wellbore;

a cross-bore having a first end and a second end, the cross-bore intersecting the channel; and a piston having a piston head, the piston moveably disposed in the cross-bore in a manner such that the piston head may be selectively moved to a position in the channel.

38. The method of claim 31, wherein the pulse generator comprises:

a valve body forming a fluid channel in communication with the fluid in the wellbore;

a cross-bore having a first end and a second end, the cross-bore intersecting the channel; and a piston having a piston head, the piston moveably disposed in the cross-bore in a manner such that the piston head may be selectively moved to a position in the channel.

39. The method of claim 33, wherein the pulse generator comprises:

a valve body forming a fluid channel in communication with the fluid in the wellbore;

a cross-bore having a first end and a second end, the cross-bore intersecting the channel; and a piston having a piston head, the piston moveably disposed in the cross-bore in a manner such that the piston head may be selectively moved to a position in the channel.

40. The method of claim 34, wherein the pulse generator comprises:

a valve body forming a fluid channel in communication with the fluid in the wellbore;

a cross-bore having a first end and a second end, the cross-bore intersecting the channel; and a piston having a piston head, the piston moveably disposed in the cross-bore in a manner such that the piston head may be selectively moved to a position in the channel.

41. The method of claim 36, wherein the pulse generator comprises:

a valve body forming a fluid channel in communication with the fluid in the wellbore;

a cross-bore having a first end and a second end, the cross-bore intersecting the channel; and a piston having a piston head, the piston moveably disposed in the cross-bore in a manner such that the piston head may be selectively moved to a position in the channel.

42. The method of claim 29, wherein the pulse generator includes a fast-acting valve adapted for releasing a burst of fluid from the wellbore.

43. The method of claim 31, wherein the pulse generator includes a fast-acting valve adapted for releasing a burst of fluid from the wellbore.

44. The method claim 33, wherein the pulse generator includes a fast-acting valve adapted for releasing a burst of fluid from the wellbore.

45. The method of claim 34, wherein the pulse generator includes a fast-acting valve adapted for releasing a burst of fluid from the wellbore.

46. The method claim 36, wherein the pulse generator includes a fast-acting valve adapted for releasing a burst of fluid from the wellbore.

47. The method of claim 42, wherein the pulse generator further includes a chamber in connection with the fast-acting valve for capturing the burst of fluid from the wellbore.

48. The method of claim 46, wherein the pulse generator further includes a chamber in connection with the fast-acting valve for capturing the burst of fluid from the wellbore.

* * * * *